US009244389B2

(12) United States Patent
Sandler et al.

(10) Patent No.: US 9,244,389 B2
(45) Date of Patent: Jan. 26, 2016

(54) PRINTING SYSTEMS UTILIZING INKS WITH HIGH SOLIDS CONTENT

(71) Applicant: HEWLETT-PACKARD DEVELOPMENT COMPANY, L.P., Houston, TX (US)

(72) Inventors: Mark Sandler, Rehovot (IL); Shai Lior, Rehovot (IL); Avner Schneider, Ness Ziona (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/600,860

(22) Filed: Jan. 20, 2015

(65) Prior Publication Data

US 2015/0301482 A1 Oct. 22, 2015

Related U.S. Application Data

(63) Continuation of application No. 13/982,209, filed as application No. PCT/US2011/023192 on Jan. 31, 2011, now Pat. No. 9,037,047.

(51) Int. Cl.
*G03G 15/10* (2006.01)

(52) U.S. Cl.
CPC ..... *G03G 15/104* (2013.01)

(58) Field of Classification Search
CPC ..... B41J 2/175; B41J 2/18; B41J 13/10; B41J 15/104
USPC ..... 399/57, 233, 246, 247, 250; 347/84, 85, 347/90, 100
See application file for complete search history.

(56) References Cited

U.S. PATENT DOCUMENTS

| | | | | |
|---|---|---|---|---|
| 5,306,590 | A | 4/1994 | Felder | |
| 5,345,296 | A | 9/1994 | Wellings | |
| 5,530,533 | A | 6/1996 | Wallace | |
| 5,950,054 | A * | 9/1999 | Kim | 399/237 |
| 6,341,209 | B1 * | 1/2002 | Kim et al. | 399/237 |
| 6,694,112 | B2 * | 2/2004 | Sasaki | G03G 15/104 399/238 |
| 7,432,033 | B2 | 10/2008 | Chou et al. | |
| 2001/0008585 | A1 * | 7/2001 | Hagiwara | G03G 15/105 399/57 |
| 2001/0022901 | A1 | 9/2001 | Suetsugu | |
| 2008/0181671 | A1 * | 7/2008 | Oda | G03G 21/10 399/241 |
| 2008/0298843 | A1 * | 12/2008 | Hobo | G01F 23/226 399/238 |
| 2010/0225715 | A1 | 9/2010 | Bachar et al. | |
| 2011/0206417 | A1 * | 8/2011 | Oda | G03G 15/104 399/238 |

(Continued)

FOREIGN PATENT DOCUMENTS

| | | | |
|---|---|---|---|
| JP | 2005-153438 | A | 6/2005 |
| KR | 10-0300989 | B1 | 9/2001 |

(Continued)

*Primary Examiner* — Francis Gray

(57) ABSTRACT

A printing system utilizing inks with high solids content includes a mixing unit for receiving a high solids content ink and producing a concentrated ink and an interim tank for receiving the concentrated ink from the mixing unit. An ink tank receives the concentrated ink from the interim tank and produces printing ink. An liquid electro-photographic print engine receives the printing ink from the ink tank. A fluid return line is connected between the mixing unit and at least one of the interim tank and the ink tank, the mixing unit receiving fluid from at least one of the interim tank and the ink tank and mixing the fluid with the high solids content ink. A method for liquid electro photographic printing using high solid content ink is also provided.

20 Claims, 7 Drawing Sheets

(56) References Cited

U.S. PATENT DOCUMENTS

2011/0206418 A1* 8/2011 Hobo ..... G03G 15/104
399/238
2012/0201555 A1* 8/2012 Nishiyama ..... G03G 15/104
399/55

FOREIGN PATENT DOCUMENTS

KR 20090079050 A 7/2009
WO WO-2008054386 A1 5/2008

* cited by examiner

PRINTING SYSTEMS UTILIZING INKS WITH HIGH SOLIDS CONTENT

BACKGROUND

An Electro-Photography (EP) printing device forms an image on media typically by first selectively charging a photoconductive drum in correspondence with the image. Colorant is applied to the photoconductive drum where the drum has been charged, and then this colorant is transferred to the media to form the image on the media. Liquid Electro-Photographic (LEP) printing devices employ liquid ink that contains a carrier fluid and pigment solids which are suspended in the carrier. During printing, the carrier fluid allows the solid particles to be mixed, transported, and deposited on the photoconductive drum. The liquid ink is applied to the photoconductive drum where the drum has been charged. Before the solid particles are deposited on the substrate, the majority of the carrier fluid is extracted. A large percentage of the carrier fluid is captured and recycled. However, during the printing process excessive carrier accumulates in the printing system and is discarded.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

As discussed above, Liquid Electro-Photographic (LEP) printing devices employ liquid ink that is applied to the photoconductive drum and adheres to portions of the drum that have been charged. The liquid ink contains a carrier fluid and pigment solids which are suspended in the carrier. The LEP printing device uses the liquid ink to form images which have offset look and feel and photo quality reproduction.

The ink, including the carrier and solid particles, is manufactured and shipped to the printing site. During printing, the carrier fluid allows the solid particles to be mixed, transported, and deposited on the photoconductive drum. Additionally, the ink particles absorb a small percentage of the carrier. This changes the mechanical behavior of the ink particles and causes the ink particles to become more plastic and form a thin uniform film on the drum. Before the solid particles are deposited on the substrate, the majority of the carrier fluid is extracted. A large percentage of the carrier fluid is captured and recycled. However, during the printing process excessive carrier accumulates in the printing system and is discarded. The purchase, storage, and disposal of the excess carrier represent significant costs.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

As used in the specification and appended claims, the term liquid electro photographic (LEP) printer or printing press refers to a printing process which combines electrostatic image creation with blanket image transfer to a substrate. As used in the specification and appended claims, the term "high solids content ink" refers to liquid electro photographic inks which have a solids content of 40% or greater. In one example, a high solids content ink includes at least 65% solids. These solids are typically conglomerates which have an aggregate particle size of hundreds of microns. These particles are adapted to absorb a portion of the liquid carrier. For example, 5% of the liquid carrier may be absorbed by the particles.

Figure 1:
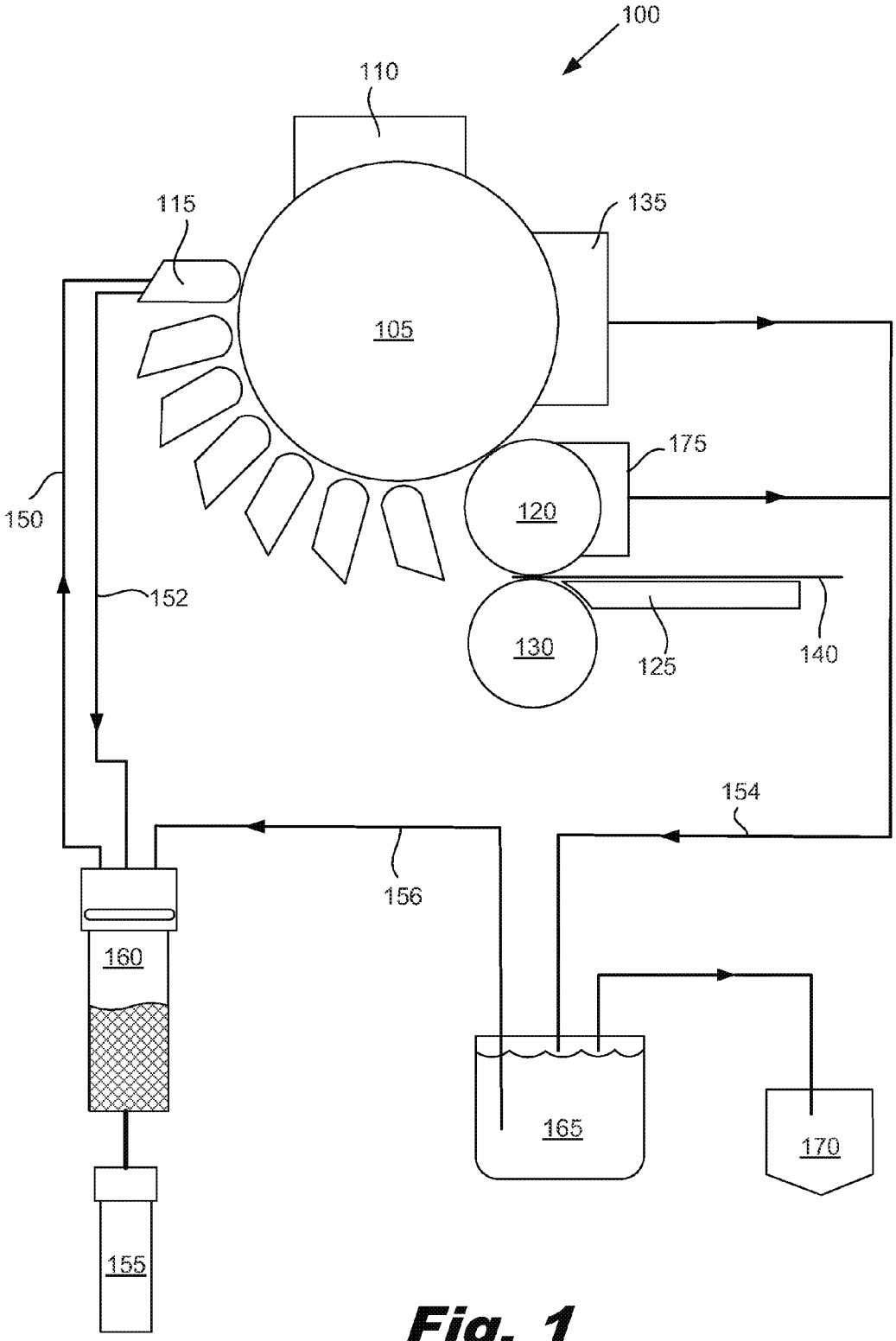
FIG. 1 is a diagram of one illustrative digital LEP system, according to one example of principles described herein.

FIG. 1 is a diagram of one illustrative embodiment of a digital LEP system (100) which uses low solid content ink. A number of illustrative modifications to the LEP system are then described which allow the LEP system to use high solid content ink. In an LEP system the desired image is initially formed on the photo imaging cylinder (105), transferred to the blanket cylinder (120), and then transferred to the substrate (140). The desired image is communicated to the printing system (100) in digital form. The desired image may be text, pictures, black/white images, partial color, full color images, or any combination of text and images.

According to one illustrative embodiment, an image is formed on the photo imaging cylinder (105) by rotating a clean, bare segment of the photo imaging cylinder (105) under the photo charging unit (110). A uniform static charge is deposited on the photo imaging cylinder (105) by a corona wire. As the photo imaging cylinder (105) continues to rotate, it passes through the laser imaging portion of the photo charging unit (110). A number of diode lasers dissipate the static charges in portions of the image area to leave an invisible electrostatic charge pattern that replicates the image to be printed.

A number of ink tanks (160) contain inks which are supplied to corresponding Binary Ink Developer (BID) units (115). There is one ink tank (160) with a corresponding BID unit (115) for each ink color. For purposes of illustration, only one ink tank (160) is shown. According to one illustrative embodiment, the ink is supplied in concentrated form in an ink can (155). The concentrated paste typically includes about 15% to 25% ink solids, with the balance being carrier fluid. Concentrated paste is dispensed from the ink can (155) into the ink tank (160). In the ink tank (160), the concentrated paste is mixed with carrier fluid to form an ink with approximately 1% to 10% ink solids, with the balance being carrier fluid. Carrier fluid is added to the ink tank (160) from the carrier tank (156) through the carrier input line (156). The characteristics of the ink in the ink tank (160) are carefully controlled to maintain the printing quality of the system (100). For example, the ink tank (160) may contain a number of sensors which detect the temperature, density, charge, amount, and flow rate of the ink. If any of these parameters drift out of a set range, appropriate correction is taken. For example, if the temperature of the ink is too high, coolant may be circulated through a heat exchanger in the ink tank to cool the ink. If the density of the ink is too low, more ink solids may be added from the ink can (155). A pump inside the ink tank (160) provides the associated BID (115) with the desired amount of ink through a BID supply line (150).

During printing, the appropriate BID unit (115) is engaged with the photo imaging cylinder (105). The engaged BID unit (115) presents an inking roller which has a uniform film of ink to the photo imaging cylinder (105). The ink contains the electrically charged pigment particles (ink solids) which are attracted to the opposing electrical fields on the image areas of the photo imaging cylinder (105). The ink solids are repelled from the non-image areas. The carrier fluid and unused ink solids return through the BID return line (152) to the ink tank (160) for reconditioning and recirculation back to the BID unit (115). When the image areas of a given impression cover large areas, the amount of ink solids extracted from the ink increases. This rapid consumption of ink solids results in more excess carrier fluid. For example, printing a large photograph will require more ink solids than printing a page of text and will result in a larger amount of excess carrier fluid.

The photo imaging cylinder (105) now has a single color ink image on its surface which is formed by the ink solids adhering to the oppositely charged portions of the photo imaging cylinder (105). In addition to the ink solids, the photo imaging cylinder (105) also carries some carrier fluid. The photo imaging cylinder (105) continues to rotate and transfers the ink image to a blanket cylinder (120). The process of transferring the ink image from its origin on the photo imaging cylinder (105) to the blanket cylinder (120). The blanket cylinder (120) then transfers the ink image to the substrate. This process is called "offset printing." The offset printing method has several advantages. First, the offset process protects the photo imaging cylinder (105) from wear which would occur if the substrate was to directly contact the photo imaging cylinder (105). Second, the blanket cylinder (120) is covered with a renewable rubber blanket. This rubber blanket compensates for unevenness of the substrate surface and deposits ink uniformly into the bottom of any depressions or grain. Consequently, the illustrative digital LEP system (100) can print on a very wide range of substrate surfaces, textures, and thicknesses.

The blanket cylinder (120) is heated to increase the plasticity and density of the ink solids. The heat vaporizes most of the carrier fluid which was transferred from the photo imaging cylinder (105) to the blanket cylinder (120). The majority of the vapor is captured by a condensing station (175). The condensing station (175) is only one part of the capture and control system for excess carrier fluid. A variety of other components, including shrouds, fans, trays, scrubbers, particulate filters, and other elements can be used to capture and recycle the carrier fluid.

The substrate (140) enters the printing system (100) from the right, passes over a feed tray (125), and is wrapped onto the impression cylinder (130). As the substrate (140) contacts the blanket cylinder (120), the single color ink image is transferred to the substrate (140).

The photo imaging cylinder (105) continues to rotate and brings the portion of the cylinder surface which previously held the ink image into a cleaning station (135). The cleaning station (135) serves multiple purposes, including cleaning any stray particulates or fluids from the photo imaging cylinder (105) and cooling the outer surface of the photo imaging cylinder (105). The cleaning station (135) may use recycled carrier fluid as a cleaning agent. Excess or contaminated carrier fluid from the cleaning station (135) may join carrier fluid from the condensing station (175) and pass through a capture line (154) to the carrier tank (165). The excess carrier fluid can be reconditioned using a number of techniques. For example, water may be extracted from the carrier fluid by a scrubber and particulates may be extracted from the carrier fluid using a porous or electrostatic filter. When more excess carrier fluid accumulates than the carrier tank (165) can accommodate, carrier fluid is passed into the disposal tank (170).

The creation, transfer, and cleaning of the photo imaging cylinder (105) is a continuous process, with hundreds of images being created and transferred per minute. To form a single color image (such as a black and white image), one pass of the substrate (140) between the impression cylinder (130) and blanket cylinder (120) completes transfer of the image. For a multiple color image, the substrate (140) is retained on the impression cylinder (130) and makes multiple contacts with the blanket cylinder (120). At each contact, an additional color is placed on the substrate. For example, to generate a four color image, the photo charging unit (110) forms a second pattern on the photo imaging cylinder (105) which receives the second ink color from a second binary ink developer (115). As described above, this second ink pattern is transferred to the blanket cylinder (120) and impressed onto the substrate (140) as it continues to rotate with the impression cylinder (130). This continues until the desired image is formed on the substrate (140). Following the complete formation of the desired image on the substrate (140), the substrate (140) can exit the machine or be duplexed to create a second image on the opposite surface of the substrate (140).

There may be a number of ink tanks (160) and associated BIDs (115). For clarity, only one ink tank is shown. Typically there is one ink tank for each of the seven BIDs (115). In one offset printing technique, four process colors are used: Cyan, Magenta, Yellow, and Key (black). Some more advance processes use six process colors to compensate for limitations in the four color method. Additionally, spot colors may be desirable to achieve the desired visual or textual effect. For example, spot colors may produce metallic, fluorescent, spot varnish, coating, or other effects. Custom spot colors may be mixed on site or ordered. These custom spot colors may be more efficient in generating the desired color and/or provide specialized visual effects on the printed substrate. For example, spot colors are particularly effective in security printing, such as money, passports, bonds and other printed documents.

The advantages of the illustrative digital offset LEP system described above include consistent dot gain, optical densities, and colors. Because the printing system is digital, the operator can change the image being printed at any time and without any reconfiguration. Further, the printing system produces uniform image gloss, a broad range of ink colors, compatibility with a wide variety of substrate types, and almost instantaneous image drying.

The physical inputs to the printing system are ink concentrate (ink solids and carrier fluid) and substrate material. During the printing process, very little (approximately 5%-15%) of the carrier fluid is consumed or lost. Most of the carrier fluid is recovered. Consequently, the physical outputs from the printing system are printed images (ink solids on the substrate) and excess carrier fluid. While the printed images are the desired output, the excess carrier fluid is a waste which requires appropriate disposal. By minimizing the carrier fluid which is input into the system, the cost of transporting, storing, and disposing of the carrier fluid can be reduced. Additionally, the overall cost of producing the printed substrates can be reduced.

Figure 2:
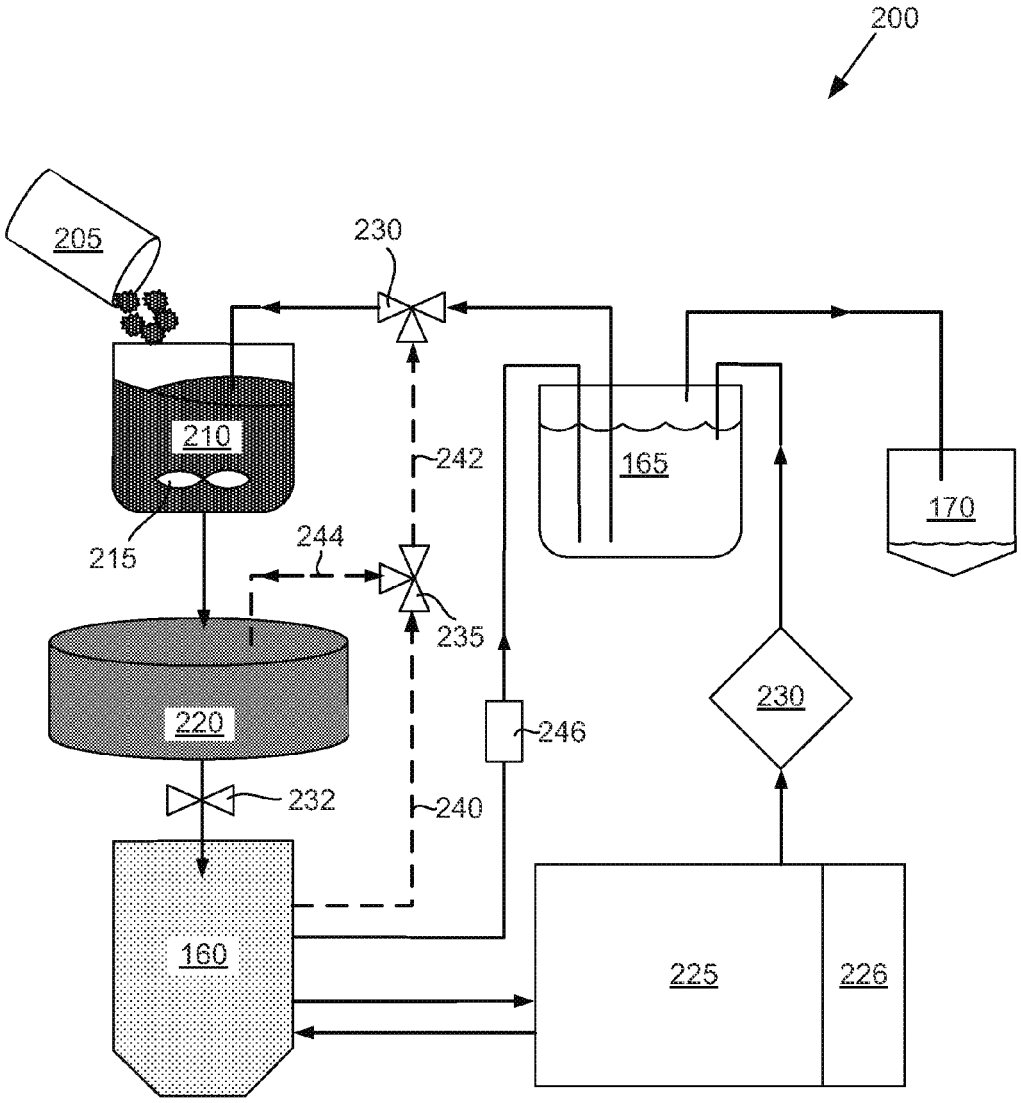
FIG. 2 is a diagram of an illustrative digital printing system utilizing liquid electro-photographic inks with high solids content, according to one example of principles described herein.

FIG. 2 is a diagram of an illustrative digital printing system (200) utilizing liquid electro-photographic inks with high solids content. In this figure, the focus is on the ink formation process and the routing of the carrier fluid through out the system. The print engine, which was described in detail with respect to FIG. 1, is represented as box (225). In this implementation, high solids content ink (205) is introduced into the system (200). The high solids content ink (205) has a much higher solids content than the ink paste discussed with respect to the system shown in FIG. 1. For example, the high solids content ink (205) may include approximately 50% to 95% ink solids with the balance being carrier fluid. The high solids content ink (205) has the form of conglomerated particles with sizes large enough not to create a dust hazard. These conglomerated particles are dispensed into a dosing and mixing unit (210), where they are combined with fluid from the carrier tank (165), interim tank (220), or from the ink tank (160). A high shear mixer (215) combines the high solid content ink with the fluid and breaks down the conglomerated particles into smaller pieces. The high shear mixer (215) may be an impeller, a gear pump, an ultrasonic unit, or other mixer which can apply appropriate levels of shear which break down the conglomerated particles and disperse them to form a concentrated ink with a solids content of approximately 10% to 30%.

This concentrated ink is then passed into an interim tank (220) where it can be stored and further conditioned. The interim tank (220) can accept additional carrier fluid through a system of attached lines (240, 242, 244) and valves (230, 235). As dictated by the printing demand, the concentrated ink from the interim tank (220) is selectively added through the valve (232) to the ink tank (160) where the concentrated ink is further diluted by carrier fluid to form a printing ink with approximately 1% to 10% solids.

This printing ink is supplied from the ink tank (160) to the print engine (225). As discussed above, in the liquid electro-photographic print engine (225) the BID applies a film of ink to charged portions of the imaging cylinder. This film of ink is approximately 20% to 25% ink solids. The film of ink is then deposited onto the heated blanket cylinder, where the carrier fluid is driven off and condensed. This increases the solids content to approximately 95%, with a portion of the remaining carrier fluid being absorbed into the interior of the particles.

The excess carrier fluid is collected by capture and control devices (230), reconditioned and returned to the carrier tank (165) for recycling. A capture and control efficiency of 85%-90% has been found to return enough of the carrier fluid to the system to enable the use of high solid content inks without the need to add carrier fluid to the press separately. Additionally, a high capture and control efficiency reduces airborne volatile organic compounds which can foul surfaces. The various other systems in the printing system (200) can draw on the carrier fluid contained in the carrier tank (165) as needed to create the desired ink or perform a desired cleaning function. Various valves (230, 235) control the flow of carrier fluid and ink between the various tanks (160, 165, 210, 220).

If there is excess carrier fluid generated by the system, it is transported out of the carrier tank (165) and into the overflow tank (170) for disposal. However, by introducing high solid content ink (205) into the system, the amount of carrier fluid which is consumed or lost during the printing process (i.e. the output flux of carrier fluid) can be approximately balanced by the carrier fluid which is introduced into the printing process. Because less carrier fluid is introduced into the system, little or no waste carrier fluid is generated by the printing process.

The interim tank (220) can accept fluids from the ink tank (160) and also distribute fluid to both the mixing unit (210) and the ink tank (160). The fluid from the interim tank (220) is directed to the desired location through a system of attached lines (240, 242, 244) and valves (230, 232, 235). The interim tank (220) can serve a number of functions. For example, the interim tank (220) may allow for batch processing in the mixing unit (210). The mixing unit (210) can receive a specific amount of ink solids (205) and a corresponding amount of carrier fluid from the interim tank (220), the ink tank (160) and/or the carrier tank (165). This batch is then mixed until the ink solids are broken down into the desired size and mixed with the carrier fluid. The mixed high solid content ink is then passed into the interim tank (220), where it is stored and dispensed into the ink tank (160) as needed. During periods of heavy printing, the interim tank (220) provides a reservoir of ink solids which are readily diluted and distributed in the ink tank (160). As discussed below, when printing conditions are such that the fluids in the ink tank (160) exceed the capacity of the ink tank (160), the excess fluid can be passed into the interim tank (220) without filtering out the ink solids. This excess fluid is then reintroduced into the system without wasting the ink solids or consuming filtering media.

In one example, the introduction of additional high solids content ink (205) into the printing system (200) is approximately matched to the amount of ink which is consumed by the printing system (200). For example, an HP Indigo 5000® printing press was found to consume approximately 30 grams of ink solids per minute in order to support maximum coverage printing without pauses. Consequently, in this example the yield of the dosing and mixing unit (210) is at least 30 grams of solids per minute. The dosing and mixing unit (210) is connected to a press control system and is synchronized with the printing operations. Each time the amount of ink in the ink tank (160) is decreased below a predefined limit, a supply pump is operated for a predefined time to supply a fresh amount of ink from the interim tank (220). In parallel, the amount of ink in the dosing and mixing unit (210) is monitored. When the level of ink in the mixing unit (210) passes a predefined minimum, the mixing unit (210) is emptied into the interim tank (220) and a new batch of ink is prepared.

In some situations, a print job may consume a large amount of ink solids due to the nature of the print job, material, or ink coverage. Usually this would result in the rapid drop in concentration of solids in the ink tank (160) as the solids are extracted and deposited on the substrate and the liquid carrier is returned from the BID (115, FIG. 1) in the print engine (225) to the ink tank (160). To compensate, additional ink (which includes both ink solids and carrier fluid) is added to the ink tank (160). This can result in the overflow of the ink tank (160). However, the system shown in FIG. 2 allows for the excess carrier to be directed through a fluid return line (240, 242, 244) and valve (230, 235) system shown by dashed lines into the interim tank (220) and/or the mixing unit (210). In this example, a first pipe (240) connects the ink tank (160) to a lower three way valve (235). The lower valve (235) can selectively direct fluids from the ink tank (160) into the interim tank (220) via a second pipe (244) or to the dosing and mixing unit (210) via a third pipe (242) and upper valve (230).

The fluid return line (240, 242, 244) is connected between the mixing unit (210) and at least one of the interim tank (220) and the ink tank (160). This allows the mixing unit (210) to directly receive fluid via the fluid return line (240, 424, 244) from at least one of the interim tank (220) and the ink tank (160). The mixing unit (210) then mixes the fluid with the high solids content ink (205) to produce the concentrated ink. This redistribution of fluid with low solids concentrations to the mixing unit (210) effectively recycles the carrier fluid within the ink system.

Because the excess fluid from the ink tank (160) contains ink particulates of the same color which are in the destination tanks (210, 220), it may be unnecessary to purify the excess carrier prior to depositing into the tanks (210, 220). This scheme efficiently recycles the overflow of the ink tank (160) and prevents the unnecessary disposal of the fluid in the ink tank (160). If the excess fluid from the ink tank (160) is sent to the carrier tank (165), a filter (246) is used to remove ink solids or other particulates. This prevents cross contamination between other colors of ink which also draw from the carrier tank (165). The system of a mixing unit (210), an interim tank (220), and an ink tank (160) and associated lines/valves is replicated for each ink color used in the print. As discussed above, all the ink colors may draw from the same carrier tank (165)

In one test, the LEP printing press with high capture and control efficiency and equipped with a mixing unit (210) and interim tank (220) was controlled using the algorithm described above. The algorithm was implemented by a press controller (226) and a number of sensors and actuators which are not shown in FIG. 2. The LEP printing press successfully printed with ink created by dispersing high solids content ink with more than 80% solids. Additionally, the LEP printing press successfully printed continuously with an input of high solids content ink with 65% solids.

Figure 3A:
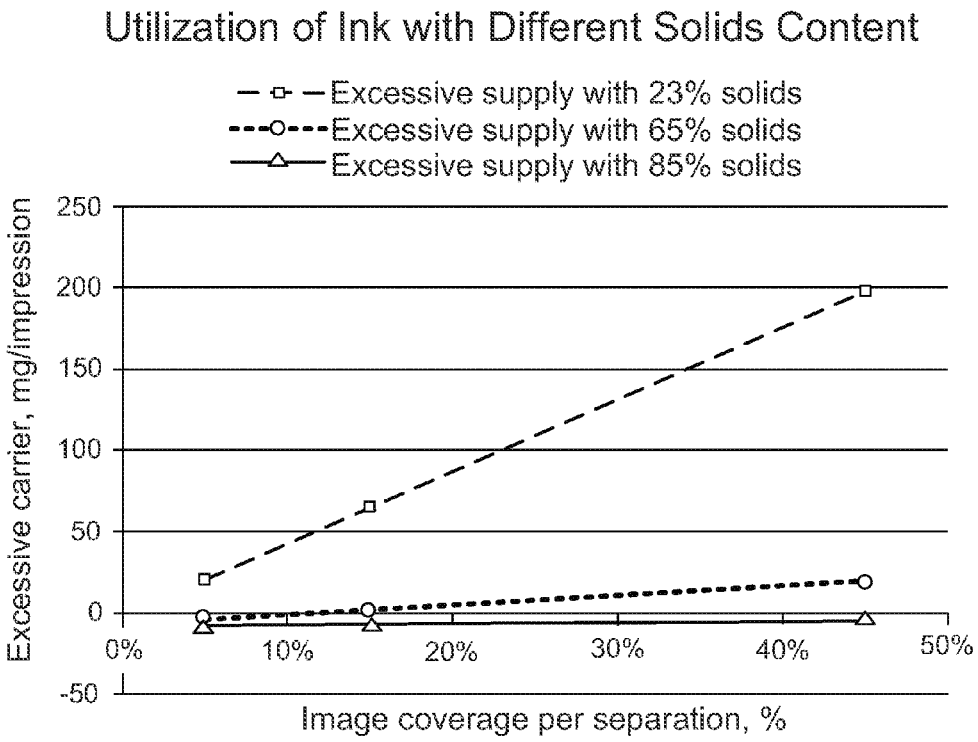
FIG. 3A is an illustrative graph showing amounts of excessive carrier produced for ink with different solids content, according to one example of principles described herein.
Figure 3B:
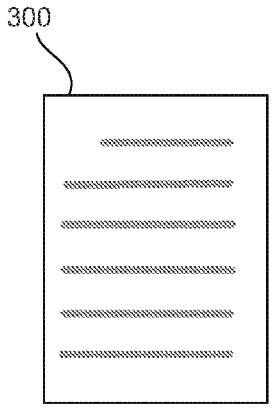
FIGS. 3B and 3C are diagrams of illustrative printed substrates, according to one example of principles described herein.
Figure 3C:
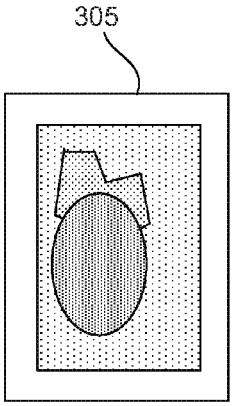

FIG. 3A is an illustrative graph showing amounts of excessive carrier produced for ink with different solids content. The horizontal axis of the graph shows image coverage per separation in percent, with lower percentages to the left and higher percentages to the right. The image coverage per separation varies as a function of the image. For example, in FIG. 3B, a text image (300) may only include one black separation which has an image coverage of approximately 6% of the total area of the image. In FIG. 3C, a photograph (305) may include 3 or more separations (cyan, yellow, magenta, black) and may have a coverage of 40% or more for each separation. Images with greater image coverage consume more ink solids because the ink covers a greater portion of the substrate.

The vertical axis of the graph shows the amount of excessive carrier fluid, measured in milligrams per impression. The amount of excessive fluid carrier for inputs with three different concentrations of solids was measured. A first input included 23% ink solids, with the balance being carrier fluid. For an image coverage of 6%, the first input generated approximately 25 milligrams of excessive carrier fluid per impression. For an image coverage of approximately 15%, the first input generated approximately 70 milligrams of excessive carrier fluid per impression. For an image coverage of 45%, the first input generated almost 200 milligrams of excessive carrier per impression. As the printing continues and additional ink with 23% solids is added, the excessive carrier fluid continues to accrue and eventually must be disposed of.

The other two inks with higher solids concentrations can also be used by the illustrative LEP systems: a first high solids content ink with 65% solids and a second high solids content ink with 85% solids. As shown in the graph, printing with the ink input with 65% solids produces a small deficit of carrier fluid when printing images with a small image coverage per separation. In this case, carrier fluid may need to be added to the printing system. However, as the image coverage increases and ink solids are consumed more rapidly, the system begins to generate small amounts of excessive carrier fluid. For example, when the image coverage is 45%, the ink input with 65% solids produces approximately 20 milligrams of excessive fluid per impression. This is an order of magnitude less waste than the ink supply with 23% solids.

The ink input with 85% solids show far less dependence between excess carrier amounts and image coverage amounts. The ink input with 85% solids maintains a small deficient of carrier fluid at all image coverages. Consequently, some carrier fluid may need to be added periodically. However, there would be no excessive carrier fluid to be disposed of as the total carrier fluid added to the system would match the amount of carrier fluid which was consumed by the system. Operating with an ink input with 85% solids ensures that there is no liquid carrier waste for all working modes and image coverages. Additionally, the ink with 85% solids would be less bulky, weigh less, and be less expensive to transport and store than ink with 23% solids.

Figure 4:
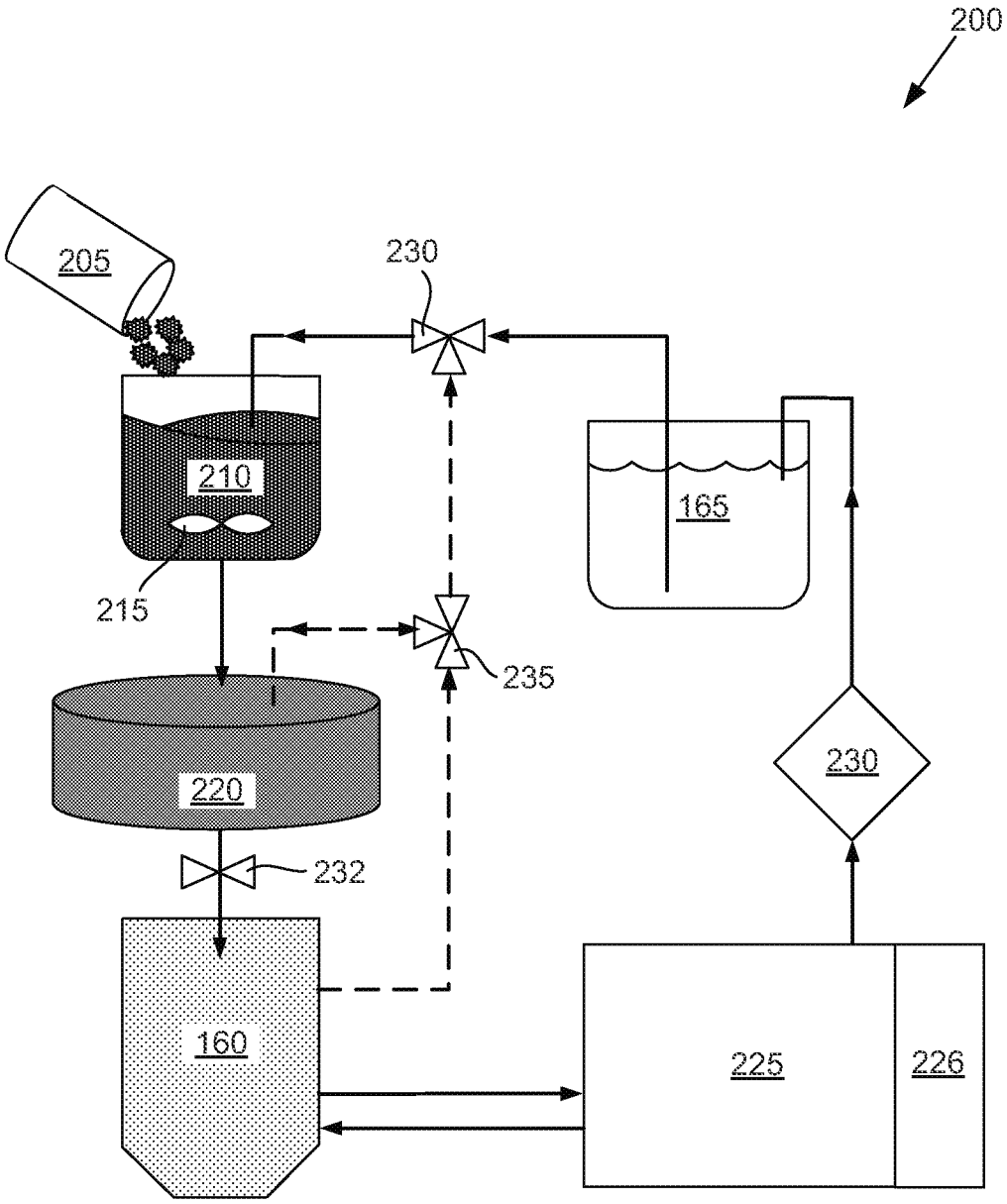
FIG. 4 is a diagram of an illustrative digital printing system utilizing liquid electro-photographic inks with high solids content, according to one example of principles described herein.

FIG. 4 shows a simplified version of the LEP printing system (200) which accepts input ink (205) with such a high solid content that printing creates a carrier fluid deficit. In some implementations, this could eliminate the need for the overflow tank (170, FIG. 2) and lines from the ink tank (160, FIG. 2) to the carrier tank (165, FIG. 2). Additional fluid is added to the carrier tank (165) as needed to maintain the operation of the printing press. When operating with ink inputs with high solids content, the deposition of the required amount of additional carrier fluid into the mixing unit (210), interim tank (220), and ink tank (160) could be handled by an algorithm in the press controller (226) which gathers data related to the consumption rate, solids concentration, liquid levels, and other information. The algorithm then directs additional carrier fluid to the desired location.

In the LEP printing system (200) described above, the use of high solids content ink allows for the ink carrier consumption of the press to be decreased by a factor of 10 or more. This minimizes ink packaging, storage, and transportation. In some implementations, this can reduce the cost per printed page by up to 50%. The carrier fluid waste at the printing site is dramatically decreased. This saves the press operator disposal costs and significantly decreases the environmental impact of LEP printing.

Figure 5:
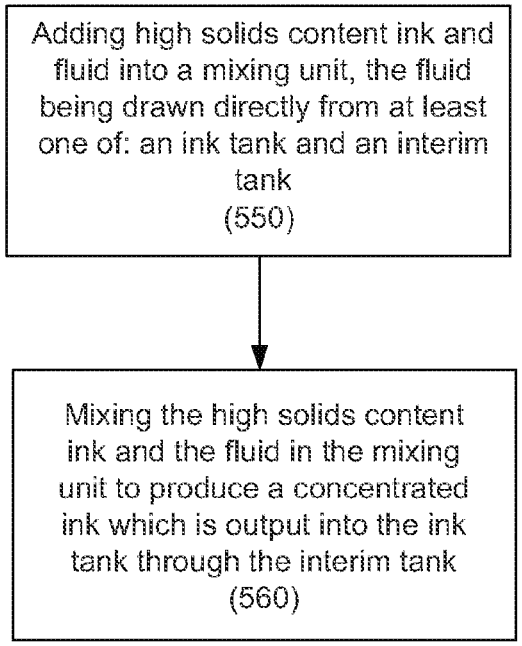
FIG. 5 is a flowchart showing an illustrative method for producing liquid electro-photographic inks with high solids content for use in a printing system, according to one example of principles described herein.

FIG. 5 is a flowchart showing an illustrative method for producing liquid electro-photographic inks with high solids content for use in a printing system, according to one example of principles described herein. As shown in FIG. 5, this method includes adding (550) high solids content ink and fluid into a mixing unit (210), the fluid being drawn directly from at least one of: an ink tank (160) and an interim tank (220); and mixing (560) the high solids content ink and the fluid in the mixing unit (210) to produce a concentrated ink which is output into the ink tank (160) through the interim tank (220).

Figure 6:
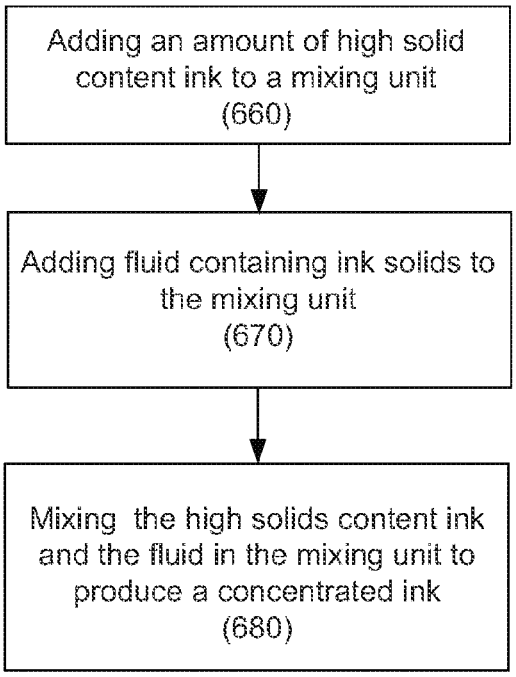
FIG. 6 is a flowchart showing an illustrative method for producing liquid electro-photographic inks with high solids content for use in a printing system, according to one example of principles described herein.

FIG. 6 is a flowchart showing an illustrative method for producing liquid electro-photographic inks with high solids content for use in a printing system, according to one example of principles described herein. As shown in FIG. 6, this method includes adding (660) an amount of high solid content ink to a mixing unit (210); adding (670) fluid containing ink solids to the mixing unit (210); and mixing (680) the high solids content ink and the fluid in the mixing unit (210) to produce a concentrated ink.

Figure 7:
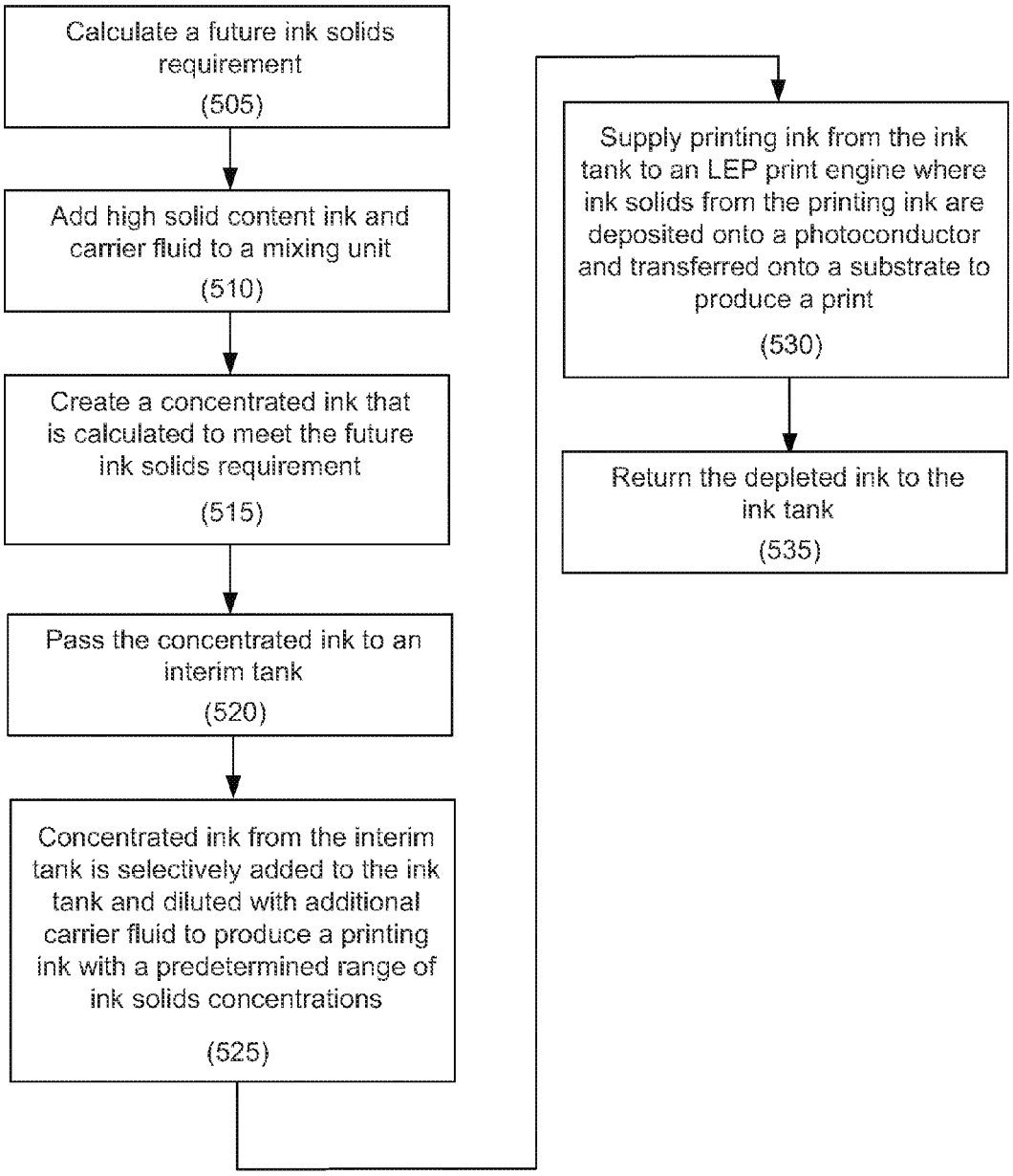
FIG. 7 is a flowchart showing an illustrative method for utilizing liquid electro-photographic inks with high solids content in a printing system, according to one example of principles described herein.

FIG. 7 is a flowchart showing an illustrative method for utilizing liquid electro-photographic inks with high solids content. A future ink solids requirement is calculated (505). This calculation may involve analyzing cued print jobs to determine the media type, number of pages, and page coverage of a given color ink to produce an anticipated demand as a function of time. High solid content ink and carrier fluid are added to a mixing unit within an LEP printing press (510) and the mixing unit creates a concentrated ink that is calculated to meet the future ink solids requirement (515). The concentrated ink is passed into an interim tank (520). In the interim tank additional dilution or other conditioning of the concentrated ink may take place. The concentrated ink from the interim tank is selectively added to the ink tank and diluted with additional carrier fluid to produce a printing ink with a predetermined range of ink solids concentrations (525). The ink solids concentrations may range from 1% solids to 10% solids. For example, within a given system the ink solids concentration may be selected to be 2%. The printing ink is supplied from the ink tank to an LEP print engine where ink solids from the printing ink are deposited onto a photoconductor and transferred onto a substrate to produce a print (530). The removal of solids from the ink produces a solids depleted ink that is returned to the ink tank (535). Additional concentrated ink is added from the interim tank to the ink tank to replace the ink solids consumed by the LEP print engine.

In some implementations, the high solid content ink has a ratio of ink solids to carrier fluid such that no excess carrier fluid is created during printing. A capture and control system within the printer captures carrier fluid, reconditions it, and returns it back into the system. For example, the capture and control system may condense carrier vapor into carrier fluid and separate any water from the carrier liquid. As discussed above, adding high solid content ink and recycling the carrier fluid can minimize or eliminate the creation of waste carrier fluid by the printing system. For example, the solids content may have a ratio of ink solids to carrier fluid such that a deficit of carrier fluid is created during printing. Additional carrier fluid can be added to the printing system to compensate for this deficit. When a high demand for ink solids creates excess fluid levels in the ink tank, printing ink from the ink tank may be returned to the interim tank and/or the mixing unit to prevent overflow of the ink tank. Because this recycling occurs within the same color system, there is no need to filter out ink solids from the return fluid. This reduces wasted ink solids and consumption of filtering media.

Figure 8:
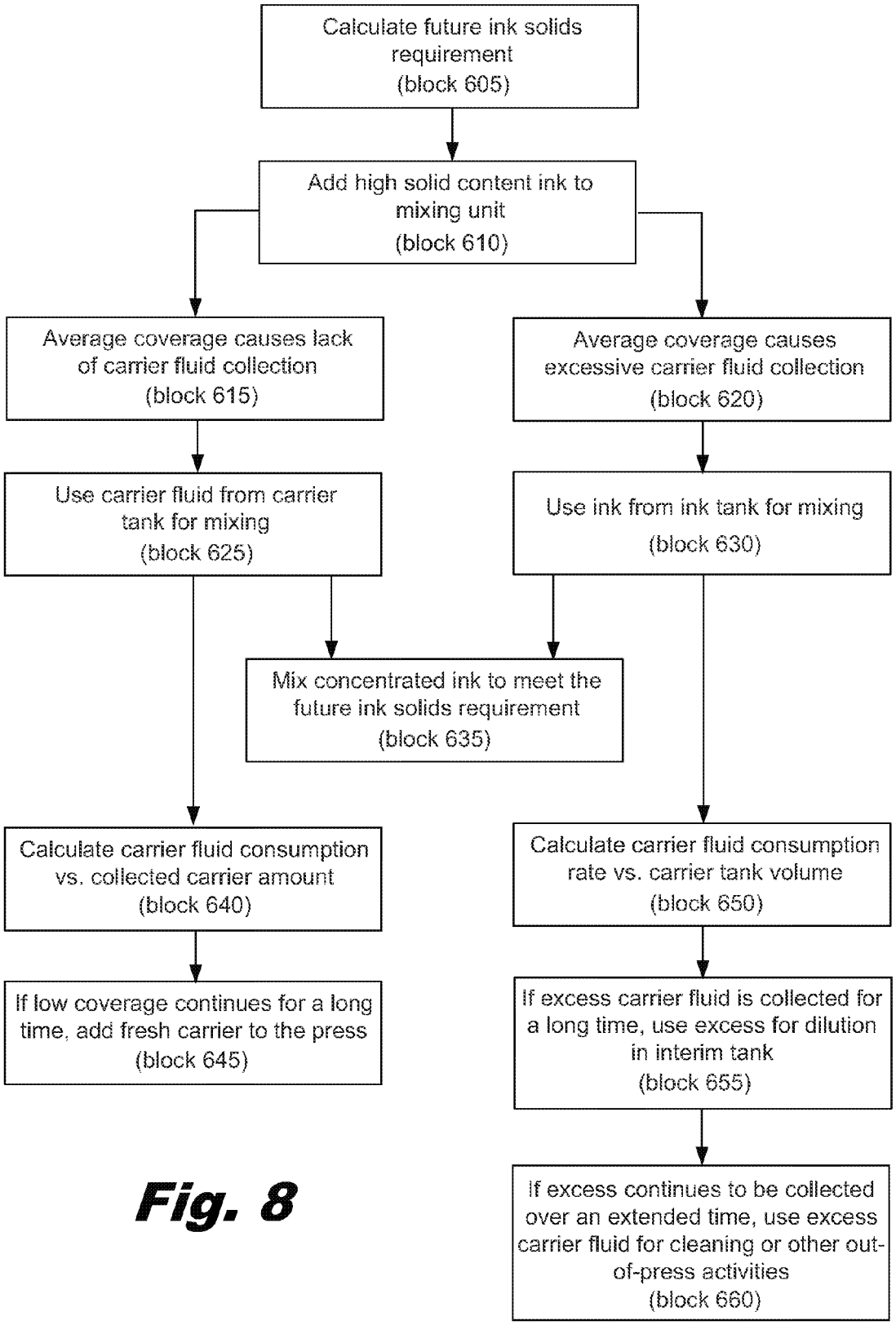
FIG. 8 is a flowchart showing an illustrative method for utilizing liquid electro-photographic inks with high solids content in a printing system, according to one example of principles described herein.

FIG. 8 is a flowchart that further describes the management of carrier fluid within an illustrative printing system that utilizes high solids content ink. The future ink solids requirement is calculated (605). As discussed above, the future ink solids requirement can be calculated using a number of inputs, including the ink requirements of the cued print jobs, the historical usage, and other factors. High solid content ink is added to the mixing unit to meet the future ink solids requirement (610). The carrier fluid added to the mixing unit comes from either the carrier tank or the ink tank depending on amount and distribution of the carrier fluid within the printing system.

When average image coverage causes a lack of carrier collection (615), the carrier fluid from the carrier tank is used for mixing (625). This addition of carrier fluid from the carrier tank compensates for low rates of carrier collection when image coverage is low. For example, when image coverage is low, less ink solids are used but carrier fluid is recovered at approximately the same rate. This results in gradual depletion of the carrier fluid. This situation is illustrated in FIG. 3A for the high solid content ink which has 65% solids. Below approximately 15% image coverage per separation, the carrier fluid is consumed faster than the ink solids. This results in a deficit of carrier fluid.

When average image coverage results in excessive carrier collection (620), ink from the ink tank is used for mixing the concentrated ink (630). This situation is also illustrated in FIG. 3A for the high solid content ink which has 65% solids. Above approximately 15% image coverage per separation, the ink solids are consumed faster than carrier fluid. This results in dilution of the ink returned to the ink tank. By introducing ink from the ink tank back into the mixing unit, this dilution can be mitigated. Additionally, as discussed above, there is no need to filter ink solids out of the diluted ink which is transferred from the ink tank to the mixing unit. The mixer then mixes high solid content ink and carrier fluid/ink to form a concentrated ink which meets the future ink solids requirement (635).

The carrier fluid consumption is tracked over extended periods of time to measure the deficit or accumulation of carrier fluid within the system. For example, the carrier fluid consumption can be calculated versus the collected carrier amount (640). The printing system detects and tracks the deficit of carrier fluid. If printing jobs with low coverage continue for a long time, the operator is notified to add fresh carrier to the press (645) when the deficit is below a predetermined threshold.

When the system determines that excess carrier fluid is accumulating in the system, the carrier consumption rate can be calculated versus the carrier tank volume (650). This allows the printing system to determine how much longer the carrier tank can continue to accept the excess carrier fluid before its capacity is exceeded. When excess carrier fluid accumulates in the system, the excess carrier fluid can be used for dilution in the interim reservoir (655). If excess carrier fluid continues to be collected over an extended period of time, the excess carrier fluid can be used for cleaning or other out-of-press activities (660). A notification to the operator could be made when the excess carrier fluid is above a predetermined threshold. The predetermined threshold may be expressed as a percentage of the carrier tank capacity, such as 80% or 90% of the volume of the carrier tank.

In some embodiments, mitigating action can be taken in response to carrier fluid accumulation or deficits tracked by the system. For example, if there is an excess of carrier fluid in the system, a low coverage printing job may be taken out of turn to increase the carrier fluid consumption relative to the amount of ink solids. Conversely, if there is a deficit of carrier fluid in the system, a high coverage printing job may be taken out of turn to increase the ink solids consumption and produce some excess carrier fluid.

Other actions can also be taken to balance carrier fluid consumption. For example, the operating parameters of the press may be adjusted or the type of ink solids concentrate which is input into the system could be adjusted. In one implementation, if excess carrier fluid is accumulating in the system, a high solids content ink with 85% solids could be introduced into the system. This results in proportionately less carrier fluid being input into the system. Conversely, if there is a deficit of carrier fluid within the system, high solids content ink with a lower ink solids concentration could be introduced into the system.

In conclusion, carrier fluid utilized by LEP printing presses is purchased, produced as part of the ink, supplied to customers, passed through the press and, finally, disposed of. This excess carrier fluid can be a significant part of cost of printing. A printing system which utilizes liquid electro photographic inks with high solids content can reduce or eliminate excess fluid carrier. This can significantly decrease the cost of prints, reduces supply chain requirements, and minimizes waste creation at the printing site.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A printing system utilizing inks with high solids content comprising:

a mixing unit for receiving a high solids content ink and producing a concentrated ink;

an interim tank for receiving the concentrated ink from the mixing unit;

an ink tank for receiving the concentrated ink from the interim tank and producing printing ink, where the concentrated ink and the printing ink have different concentrations of solids;

an liquid electro-photographic print engine for receiving the printing ink from the ink tank; and a fluid return line that is connected between the mixing unit and the interim tank, such that the mixing unit directly receives fluid via the fluid return line from the interim tank and mixes the fluid with the high solids content ink to produce the concentrated ink.

2. The printing system of claim 1, in which the high solids content ink is added to the system according to an anticipated demand calculated from queued printing jobs.

3. The printing system of claim 1, in which the fluid return line further comprises a fluidic connection between the ink tank and the interim tank that directly carries fluid from the ink tank to the interim tank.

4. The printing system of claim 1, in which ink solids are not filtered from the fluid passing from the interim tank to the mixing unit.

5. The printing system of claim 1, further comprises a carrier tank containing carrier fluid, the carrier tank being fluidically connected to the mixing unit, the interim tank, and the ink tank.

6. The printing system of claim 1, in which the concentrated ink has a solids content of approximately 10% to approximately 30%.

7. The printing system of claim 1, in which the high solids content ink has a solids content of approximately 40% or greater.

8. The printing system of claim 1, in which the printing ink has a solids content of approximately 1% to approximately 10%.

9. A printing system utilizing inks with high solids content comprising:

a mixing unit for receiving a high solids content ink and producing a concentrated ink;

an interim tank for receiving the concentrated ink from the mixing unit;

an ink tank for receiving the concentrated ink from the interim tank and producing printing ink, where the concentrated ink and the printing ink have different concentrations of ink solids and the concentrated ink has an ink solids concentration of approximately 10% to approximately 30%;

an liquid electro-photographic print engine for receiving the printing ink from the ink tank; and a fluid return that is connected between the mixing unit and the ink tank, the mixing unit being configured to receive fluid via the fluid return line from the ink tank and mix the fluid with the high solids content ink to produce the concentrated ink.

10. The printing system of claim 9, in which the high solids content ink is added to the system according to an anticipated demand calculated from cued printing jobs.

11. The printing system of claim 9, in which the fluid return line further comprises a fluidic connection between the ink tank and the interim tank that carries fluid from the ink tank to the interim tank.

12. The printing system of claim 9, in which ink solids are not filtered from the fluid passing from the ink tank to the mixing unit.

13. The printing system of claim 9, further comprises a carrier tank containing carrier fluid, the carrier tank being fluidically connected to the mixing unit.

14. The printing system of claim 9, in which the high solids content ink has an ink solids content of approximately 40% or greater.

15. The printing system of claim 12, in which the printing ink has an ink solids content of approximately 1% to approximately 10%.

16. A method for liquid electro photographic printing using high solid content ink comprising:

adding high solids content ink and fluid into a mixing unit, the fluid being drawn directly from at least one of an ink tank and an interim tank; and mixing the high solids content ink and the fluid in the mixing unit to produce a concentrated ink which is output into the ink tank to form printing ink, in which the high solids content ink has a solids content of approximately 40% or greater, the concentrated ink has a solids content of approximately 10 to approximately 30%, and the printing ink has an solids content of approximately 1% to approximately 10%.

17. The method of claim 16, in which outputting the concentrated ink into the ink tank comprises selectively adding the concentrated ink from the interim tank to the ink tank where the concentrated ink is diluted with additional carrier fluid to produce a printing ink.

18. The method of claim 16, further comprising:

calculating a future ink solids requirement based on queued print jobs; and adding an amount of high solid content ink and fluid to the mixing unit to create an amount of concentrated ink which is calculated to meet the future ink solids requirement.

19. The method of claim 16, further comprising:

supplying printing ink from the ink tank to an liquid electro-photographic print engine where ink solids from the printing ink are deposited onto a photoconductor and transferred onto a substrate to produce a print; and returning depleted ink to the ink tank.

20. The method of claim 16, further comprising:

mixing the contents of the mixing tank with a high shear impeller, where the high shear impeller combines the high solid content ink with carrier fluid and breaks down conglomerated particles of the high solids content ink into smaller pieces.

* * * * *